US005806443A

United States Patent [19]

Kobayashi et al.

[11] Patent Number: 5,806,443

[45] Date of Patent: Sep. 15, 1998

[54] PULVERIZED COAL BURNER AND METHOD OF USING SAME

[75] Inventors: Hironobu Kobayashi, Hitachinaka; Kiyoshi Narato, Ibaraki-ken; Masayuki Taniguchi; Tsuyoshi Kouno, both of Hitachinaka; Hirofumi Okazaki, Hitachi; Shigeki Morita, Hiroshima; Toshikazu Tsumura, Kure, all of Japan

[73] Assignees: Hitachi, Ltd.; Babcock-Hitachi Kabushiki Kaisha, both of Tokyo, Japan

[21] Appl. No.: 462,292

[22] Filed: Jun. 5, 1995

[30] Foreign Application Priority Data

Jun. 30, 1994 [JP] Japan ..... 6-148971

[51] Int. Cl.[6] ..... F23C 1/12

[52] U.S. Cl. ..... 110/262; 110/264; 110/265

[58] Field of Search ..... 110/262, 263, 110/264, 265, 104 B, 347

[56] References Cited

U.S. PATENT DOCUMENTS

| | | | |
|---|---|---|---|
| 2,911,034 | 11/1959 | Webb . | |
| 4,702,180 | 10/1987 | Kiga | 110/264 |
| 4,748,919 | 6/1988 | Campobenedetto et al. | 110/264 |
| 4,915,619 | 4/1990 | LaRue | 110/265 |
| 5,011,400 | 4/1991 | Vatsky | 110/264 |
| 5,231,937 | 8/1993 | Kobayashi et al. | 110/265 |

FOREIGN PATENT DOCUMENTS

| | | |
|---|---|---|
| 0 554 014 | 8/1993 | European Pat. Off. . |
| 11 70 101 | 5/1964 | Germany . |
| 60-226609 | 11/1985 | Japan . |
| 61-22105 | 1/1986 | Japan . |
| 61-252412 | 11/1986 | Japan . |
| 61-280302 | 12/1986 | Japan . |

OTHER PUBLICATIONS

Patent Abstracts of Japan, vol. 008, No. 080 (M–289), 12 Apr. 1984.

*Primary Examiner*—John T. Kwon

*Attorney, Agent, or Firm*—Antonelli, Terry, Stout & Kraus, LLP

[57] ABSTRACT

To provide a pulverized coal burner capable of reducing the NOx concentration at the time of a low load, a pulverized coal burner includes a secondary air nozzle and a tertiary air nozzle concentrically positioned about the outer periphery of a fuel nozzle carrying a pulverized coal with a primary air, and two swirling flow generators are included at least one of these nozzles with a positional relation parallel to a flow of air. One of the swirling flow of the two swirling flow generators can be set strongly. And, under a condition of low air flow rate, air can be supplied from one swirling flow generator alone. Since the swirling strength of the combustion air can be increased, the concentration of NOx produced by the combustion of the pulverized coal can be reduced. Also, because the swirling strength at the time of low load can be increased, the NOx concentration can be reduced by keeping the pulverized coal flame stable.

6 Claims, 7 Drawing Sheets

PULVERIZED COAL BURNER AND METHOD OF USING SAME

BACKGROUND OF THE INVENTION

1. Field of the Invention

The present invention relates to a burner carrying pulverized coal with air flow for combustion, and more particularly to a pulverized coal burner suitably applied to a pulverized coal firing boiler which burns pulverized coal to generate steam.

A pulverized coal burner to be an application object of the present invention includes an air nozzle supplying a combustion air which is concentrically positioned about the outer periphery of the fuel nozzle carrying pulverized coal with air flow. More specifically, a burner comprises one or two air nozzle concentrically, and swirling flow generating means for swirling the combustion air are provided inside of the air nozzles.

2. Description of the Related Arts

In combustion of the pulverized coal, it is needed to control the amount of generation of nitrogen oxide (NOx). Most of NOx generated during the combustion of the pulverized coal is NOx generated by oxidation of nitrogen contained in coal. In order to reduce the amount of generation of NOx, various structures of the burner and various methods of combustion have been contrived.

As one method of reducing the amount of generation of NOx, there may be mentioned a method in which an oxidizing flame area and a reducing flame area are formed in a burner flame, so-called a flame inside two-stage combustion method. This in-flame two-stage combustion method utilizes the fact that nitrogen in coal is decomposed by hydrogen cyanide (HCN) or ammonia ($NH_3$) to be released into a gas phase during the thermal decomposition of the initial stage of the combustion and these nitrogen compounds are oxidized to become NOx, while these nitrogen compounds are precursors of NOx and are effective in reducing NOx under the condition of low oxygen concentration. That is, the burner is constructed so as to be provided with the air nozzle erupting the combustion air with a swirling flow concentrically positioned about the outer periphery of the fuel nozzle carrying pulverized coal with air flow, so that air erupted from the air nozzle is mixed with a flame at the rear stage of the flame by the action of the swirling flow, the reducing flame area is formed near the burner in the flame by performing a fuel-excessive combustion of air deficiency, and the oxidizing flame area is formed at the rear stage of the flame by performing the combustion of a high-oxygen concentration. The burners of this type are disclosed in, for example, Japanese Unexamined Patent Publication Nos. 60-226609, 61-22105 and 61-280302.

On the other hand, in these days where a nuclear power generation is a base load for an electric power supply, an operation with high load change is required for a pulverized coal fire power which has been operated in a constant load. According to the pulverized coal combustion with the burner, the flame becomes unstable when the amount of pulverized coal is reduced. Thus, there are limits to which only the pulverized coal combustion corresponds to all loads in the pulverized coal firing boiler. Thus, an auxiliary fuel nozzle composed of mainly an oil gun is incorporated in the pulverized coal burner to perform an auxiliary combustion with the oil gun during low load. One example of the burner as constructed above is disclosed in Japanese Unexamined Patent Publication No. 61-252412.

Furthermore, in the pulverized coal firing boiler, a method of the burner cut has been known in which some of the burners among a plurality of burners provided on the furnace wall of the boiler are paused in order to correspond to the load change with operation range due to only pulverized coal combustion. In addition to this, there may be considered a method of reducing the flow rate of the pulverized coal and air to be supplied to the burner at the time of a low load.

Problems to be Solved by the Invention

In order to increase operability of the pulverized coal firing boiler, it is necessary to change the load in a short period of time. When the amount of both pulverized coal and air is changed so as to discriminate between a method in which the lower limit of operating the pulverized coal burner is extended to the low load and a method of the burner cut, the method in which the lower limit of operating the pulverized coal burner can perform the load change faster than the method of the burner cut requiring time for starting and stopping a coal pulverizer.

However, in the pulverized coal burner, flow velocity of the pulverized coal particle flowing inside of a pulverized coal carrying tube cannot be reduced below a certain velocity, and thus, there are limits to which a flow rate of air supplied to the pulverized coal carrying tube is reduced. When the velocity of the pulverized coal particles is too slow, the pulverized coal particles settles in the carrying tube and causes a blockage of the carrying tube and a back flow of the flame of the furnace to the pulverized coal carrying tube.

Thus, according to the method of extending the lower limit of operation of the pulverized coal burner, the flow rate of the pulverized coal carrying air should be stabilized at some degree of the load so as to reduce the flow rate of air to be supplied to the air nozzle when the flow rate of air together with that of the pulverized coal are reduced.

When the flow rate of air to be supplied to the air nozzle is reduced, the swirl intensity of air is weakened and air is mixed with the flame not at the rear stage of the flame but at the position near the burner. As a result, it becomes difficult to form the reducing area of NOx in the flame.

SUMMARY OF THE INVENTION

An object of the present invention is to provide a pulverized coal burner comprising an air nozzle supplying a combustion air with a swirling flow being concentrically positioned about an outer periphery of a fuel nozzle carrying pulverized coal with air flow, in which a reducing area of NOx is formed excellently even under the condition of a low load, and the effect of reducing NOx at the time of the low load is improved.

Another object of the present invention is to provide a pulverized coal burner provided with an auxiliary fuel nozzle such as an oil gun, in which generation of environmental inhibitors such as soot and the like can be controlled at the time of an auxiliary combustion.

A further object of the present invention is to provide a pulverized coal combustion method in which generation of NOx can be controlled at the time of the low load in combustion by the pulverized coal.

A still further object of the present invention is to provide a pulverized coal combustion method using a pulverized coal burner provided with an auxiliary fuel nozzle such as an oil gun, in which generation of environmental inhibitors such as soot and the like can be controlled during an auxiliary combustion.

Means for Solving the Problem

A pulverized coal burner according to the present invention comprises at least one air nozzle supplying a combustion air being concentrically positioned about an outer periphery of a fuel nozzle carrying pulverized coal with air flow, and at least one air nozzle is provided with a plurality of swirling flow generating means capable of controlling swirling intensity parallel to a flow of the combustion air.

Two air nozzles may be desirably provided concentrically about the outer periphery of the fuel nozzle, and either one of which may be desirably provided with a plurality of, preferably two swirling flow generating means parallel to the flow of the combustion air.

An air flow rate control means for controlling an open angle of the nozzle to control the flow rate of the combustion air may be desirably provided at the entrance of the air nozzle so as to control the open angle of the nozzle in accordance with a change of the load.

The above-described swirling flow generating means may be formed by two register vanes integrally mounted to a supporting rod with changing angles thereof. If the angle of rotation of the supporting rod is made controllable, swirling strength can be also controlled. And, in this case, by controlling the angle of rotation of the supporting rod, air flow rate can be controlled or the inflow of air can be interrupted. This has an advantage of eliminating the need for additionally providing a flow rate control means. It is desirable to provide a partition plate between two register vanes for stopping up a gap formed therebetween.

According to the present invention, a control means controlling swirling intensity of the above-described two swirling flow generating means and open angles of the air nozzle and in accordance with load instructions may be desirably provided.

And, according to the present invention, it is desirable to provide an auxiliary fuel nozzle such as an oil gun or the like at an inside or an outside of the fuel nozzle. In the case of providing the oil gun at the outside of the fuel nozzle, six or eight oil guns may be provided at approximately equal intervals.

According to the present invention, there is provided a method of burning pulverized coal by a pulverized coal burner having two air nozzles supplying air with a swirling flow being concentrically positioned about an outer periphery of a fuel nozzle carrying pulverized coal with air flow, wherein at least one of the two concentrically provided air nozzles is provided with two swirling flow generating means parallel to the flow of air so as to erupt air from one air nozzle having the two swirling flow generating means by forming swirling flows at the time of a total load with the two swirling flow generating means, and to supply air to one swirling flow generating means alone by reducing open angles of the air nozzle having the two swirling flow generating means at the time of a low load.

According to the present invention, there is also provided a method of burning pulverized coal by a pulverized coal burner having an auxiliary fuel nozzle inside of a fuel nozzle carrying pulverized coal with air flow and two air nozzles supplying air with a swirling flow being concentrically positioned about an outer periphery of the pulverized coal fuel nozzle so as to perform burning with an auxiliary fuel at the time of a low load incapable of performing pulverized coal burning, wherein at least one of the two concentrically provided air nozzles is provided with two swirling flow generating means parallel to the flow of air so as to set swirling flow of the two swirling flow generating means in the direction opposite to each other at the time of burning by an the auxiliary fuel to perform the burning, and to set swirling flow of the two swirling flow generating means in the same direction at the time of pulverized coal burning and mixed-fuel burning of the pulverized coal and the auxiliary fuel to perform the burning.

According to the present invention, there is further provided a method of burning pulverized coal by a pulverized coal burner having two air nozzles supplying air with a swirling flow being concentrically positioned about the outer periphery of a fuel nozzle carrying pulverized coal with air flow, wherein at least one of the two concentrically provided air nozzles is provided with two swirling flow generating means parallel to the flow of air so as to swirl the two swirling flow generating means with different swirl strengths at the time of a low load.

In this case, it is desirable that strength of one of the two swirling flow generating means provided parallel to the flow of air being positioned at the side of outer peripheral wall is greater than strength of swirling flow generating means positioned at the side of inner peripheral wall.

Operation

In a pulverized coal firing boiler, in order to form a stable flame and to reduce the concentration of NOx at the time of a low load, it is important to increase a swirl number (the ratio of swirling components of velocity of jets supplied from a burner to velocity components of flowing direction) of the combustion air to bring the swirl number of the entire burner near the operational condition at the time of a total load, or to increase the swirl number higher than that at the time of the total load.

And, according to such a pulverized coal burner that erupts the combustion air from the outer periphery of the jet of the pulverized coal and the carrying air as a swirling flow, it is important to form a high temperature circulating flow in a flame even under the operational condition of the low load to collect pulverized coal in the circulating flow. To this end, it is important to allow the swirling flow generating means to be provided with a mechanism for increasing the velocity of the swirling flow even under the condition of low flow rate of the combustion air.

In a pulverized coal firing boiler, in order to prevent generation of environmental inhibitors such as soot and the like when performing auxiliary oil burning at the time of a low load incapable of performing pulverized coal burning, it is important to reduce the swirl number of the combustion air to accelerate the mixing of a fuel spray and the combustion air near the burner. To this end, when the minimum load of coal burning which burns pulverized coal is switched to a load of the auxiliary oil burning, it is important to reduce the swirl strength independently from the air flow rate to accelerate the mixing of an oil jet and the combustion air near the burner. The same is true for a case where the coal burning is switched to a mixed burning of pulverized coal and oil, and further for a case where the auxiliary oil burning is shifted to an oil burning in a burning method of switching the auxiliary oil burning to the oil burning.

That is, under a condition near the minimum load capable of performing a single burning by a pulverized burner, it becomes important to increase the swirl number of the combustion air nozzle higher than that of the condition of the total load as a distribution ratio of the air supplied from the combustion air nozzle is relatively reduced. Further, when the auxiliary oil burning, it becomes important that the combustion air is supplied by reducing the flow rate thereof with a low swirl number.

In order to satisfy the conflicting requirements as described above, for example, when the velocity of the pulverized coal-air mixture is reduced, the pulverized coal supplied from the pulverized coal nozzle is radially dispersed by the swirling flow combustion air. As a result, the ratio of the pulverized coal burning at the outer part of the flame in an atmosphere rich in the combustion air increases and the pulverized coal burning at the NOx reducing area is relatively reduced. Thus, the NOx concentration at the exit of the furnace increases.

Under the condition of coal burning with a low air flow rate, the swirling flow required for forming the NOx reducing area and the stable flame can be attained by providing a plurality of the swirling flow generators arranged in the combustion air nozzle parallel to the flow of air, that is, the swirling flow generators each corresponding to the individual divided air to supply air fed from the plurality of the swirling flow generators as the combustion air from one air nozzle and by bringing the air flow rate of one of the swirling flow generators to zero.

Under the condition of the total load of the pulverized coal burner, the swirling strength of the swirling flow generator is operated in a condition suitable for forming an NOx reducing atmosphere in the flame. With this swirling flow, a high temperature combustion air flows to the burner, so-called re-circulating flow is formed near the burner, and the pulverized coal is maintained in this area to be rapidly set fired. By attaining such ignition condition, oxygen in a pulverized coal jet is rapidly consumed and the NOx reducing area is formed.

On the other hand, under the condition of the low load of the pulverized coal burning, since means for eliminating the flow rate of the air flowing in one swirling flow generator is included, the velocity of the combustion air passing through the swirl vanes of the swirling flow generator can be controlled so as to be equal to the swirl number of the jet of the entire burner at the time of the total load.

And, by supplying the swirling flows produced in a plurality of the swirling flow generators from one air nozzle, passage walls to be newly produced by allowing individual swirling flow generators to correspond to one air nozzle can be eliminated. Since the passage walls act as resistance of the flow, attenuation of the swirling flow disappears by eliminating the passage walls and the strength of the swirling flow at the exit of the air nozzle is increased.

Since the swirling flow passes air along the outer wall of the air nozzle by its centrifugal force, the flow rate of the air flowing at distance from the pulverized coal jet can be increased by supplying a plurality of the swirling flows from one air nozzle. As a ratio of the swirling flows flowing a radial distance increases, the swirl number of the jet of the entire burner is increased. Thus, the ignitionability of the pulverized coal can be improved by further strengthening the high temperature re-circulating flow which is extremely important for the ignition, and the reduction of NOx can be accelerated by forming the reducing are of NOx more promptly.

As the invention disclosed in Japanese Unexamined Patent Publication No. 60-226609 of the prior art, there causes no problems such as the unstable ignition condition caused by the reduction of the swirl number of the entire burner ah the time of the low load, and the increase of the NOx concentration due to not forming of the NOx reducing area which are common to a burner having a damper for controlling an air flow rate provided upstream the air nozzle and swirl vanes for controlling the swirl strength provided downstream the damper. Further, the set angles of the swirl vanes of the swirling flow generator can be set in such a condition that the swirling flow can be produced with the highest degree of efficiency by the air flow rate at the time of the low load. By this, instability of a control system due to a small control width of the swirling vanes angle of the swirling flow generator which is likely to be seen in the prior art as described above can be eliminated.

The object of the present invention to eliminate instability of the flame and reduce the amount of the generation of NOx at the time of the low load by the pulverized coal burning can be attained by providing a plurality of the swirling flow generators arranged in the combustion air nozzle parallel to the flow of air, that is, the swirling flow generators each corresponding to the individual divided air to supply air fed from the plurality of the swirling flow generators as the combustion air from one air nozzle and by providing means for supplying the swirling flows fed by a plurality of the swirling flow generators with different strength.

The most preferable example of changing swirl strength of the swirling flow generator is to increase the swirl strength of the swirling flow generator positioned at a shorter air flow path from the swirling flow generator to the furnace, that is, the swirling flow generator near the outer wall of the air nozzle. This can make the swirling flow near the outer wall of the annular air nozzle to flow faster than that near the inner wall. By this, the component of the swirling direction of the velocity of the air flowing in the air nozzle increases as it moves away from the pulverized coal jet. Since the velocity distribution of this swirling flow is hydrodynamically the flow of the least pressure loss, the swirl number of the entire burner is higher than a case where air is supplied from the swirling flow generator at a constant velocity. By this, the high temperature circulating flow near the burner can be produced more stably. Thus, the ignitionability of the pulverized coal can be improved, and the NOx reducing area can be produced stably from the time of the total load to the low load.

In the case of performing the auxiliary burning by oil, the object of the present invention to control generation of environmental inhibitors such as soot and the like can be attained by providing a plurality of the swirling flow generators arranged in the combustion air nozzle parallel to the flow of air, that is, the swirling flow generators each corresponding to the individual divided air to supply air fed from the plurality of the swirling flow generators as the combustion air from one air nozzle and by providing means for setting swirling direction of the two swirling flow generators in the direction opposite to each other.

The swirling flows supplied opposite to each other cancel the swirling component thereof inside of one air nozzle positioned at downstream side of the swirling flow generator. The pressure loss of the swirling flow generator is increased together with the swirl strength of the swirling flow generator. Thus, when the swirl strength is controlled with leaving the swirling direction opposite to each other, the flow rate of the combustion air can be controlled in a state of straight flow free from the swirling flow.

For example, in case of a burner supplying air from one wind box to the furnace through two air nozzles, when the swirling flow generator of one of the air nozzles are controlled to the state as described above, small amount of air having low swirling strength can be supplied from this air nozzle and a larger amount of air can be supplied from the other air nozzle than a prior art. By effecting the above operation, mixing of the combustion air and oil spray can be accelerated at the time of auxiliary burning by the oil gun. Thus, generation of environmental inhibitors can be controlled.

DETAILED DESCRIPTION OFT HE PREFERRED EMBODIMENTS

A pulverized coal firing burner comprising swirling flow generators according to the present invention will now be described.

Embodiment 1

Figure 1:
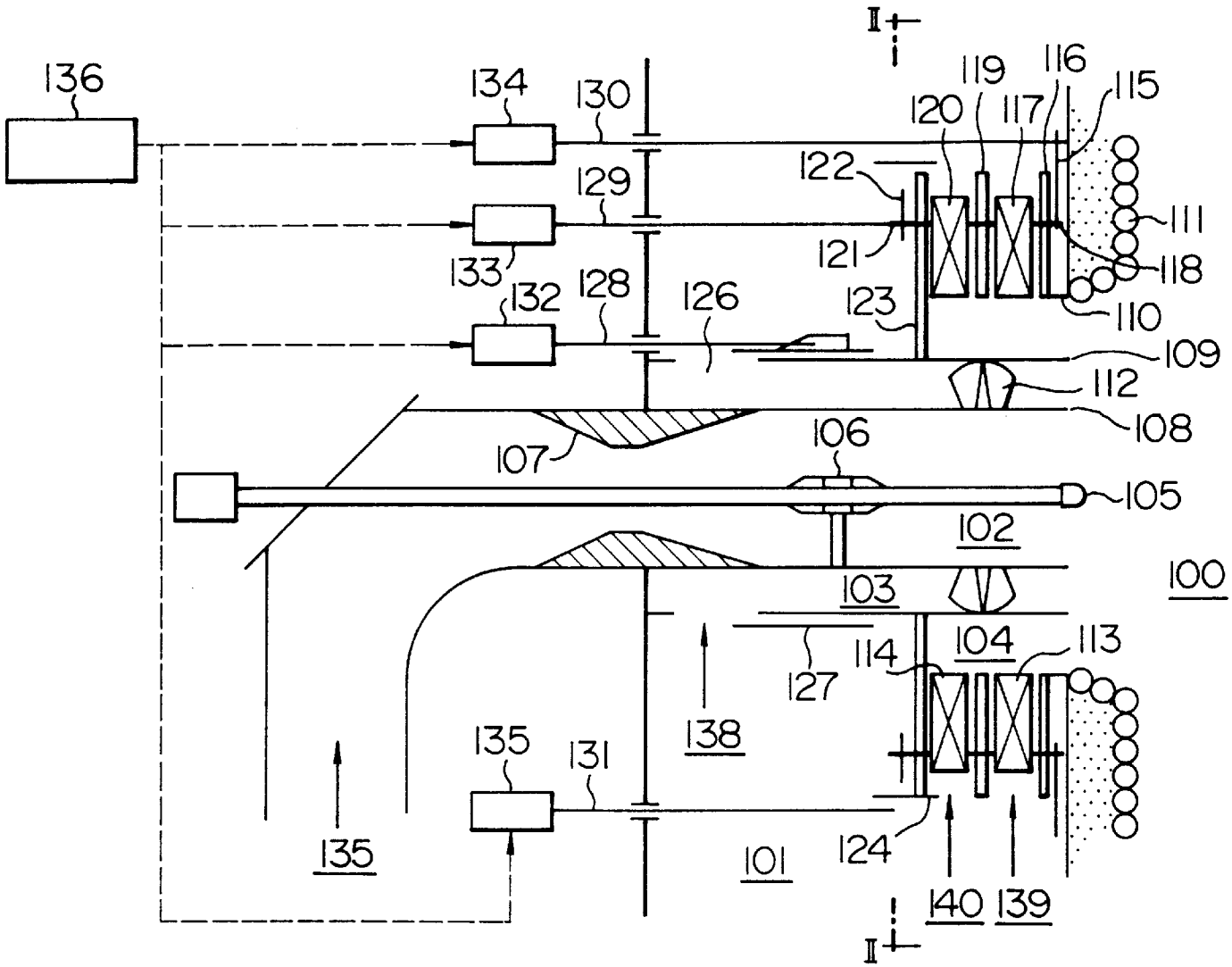
FIG. 1 is a cross-sectional view of a pulverized coal burner according to the present invention.

A pulverized coal firing burner comprising swirling flow generators shown in FIG. 1 will be described. FIG. 1 is a cross-sectional view of a pulverized coal burner including a central axis thereof. The pulverized coal burner of this embodiment is comprised of a fuel nozzle 102 mounted at the center portion of the burner, a secondary air nozzle 103 concentrically arranged about the fuel nozzle 102 for supplying the secondary air, and a tertiary air nozzle 104 mounted on the outer periphery of the secondary air nozzle 103 for supplying the tertiary air. The fuel nozzle 102 supplies a mixture gas 137 of the primary air and the pulverized coal. The secondary air nozzle 103 and the tertiary air nozzle 104 are passages for supplying a combustion air fed into a wind box 101 to a furnace 100.

The fuel nozzle 102 is a tubular passage having a primary throat 108 as an outer wall. In the case of the pulverized coal burner of this embodiment, an oil gun 105 for an auxiliary burning so as to preheat water tubes 111 mounted on the inner wall of the furnace 100 is mounted on the center portion of the fuel nozzle 102 by means of a support 106. A venturi 107 arranged at upstream of the fuel nozzle 102 plays a role in controlling a concentration distribution of the pulverized coal fed from a pulverized coal feeder (not shown in FIG. 1).

The secondary air nozzle 103 is an annular passage having the primary throat 108 as an inner peripheral wall and a secondary throat 109 as an outer peripheral wall. The secondary air nozzle 103 includes a swirling flow generator 112 and a flow control valve 127 toward the upstream from the furnace 100.

The swirling flow generator 112 feeds the secondary air 138 with a swirling flow. The swirling flow generator 112 is of an axial flow type, and consists of a plurality of fan-shaped blades provided in a circumferential direction of the passage and a supporting rod mounted integrally with these blades. The strength of the swirling flow of the swirling flow generator 112 is controlled by changing angles of the blades with a driving device (not shown). The flow control valve 127 controls a flow rate of the secondary air. The flow control valve 127 has a cylindrical shape, and is mounted at the position covering an opening of an inflow port 126 communicating the wind box 101 with the secondary throat 109. As the flow control valve 127 moves to the central axis of the burner by a connecting bar 128, an area of the opening of the inflow port 126 is changed. With this operation, the flow rate of the secondary air 138 is controlled.

The tertiary air nozzle 104 is an annular passage having the secondary throat 109 as an inner peripheral wall and a tertiary throat 110 as an outer peripheral wall. The tertiary air nozzle 104 is connected to the wind box 101 through a swirling flow generator (A) 113 and a swirling flow generator (B) 114.

The swirling flow generator (A) 113 and the swirling flow generator (B) 114 are arranged parallel to the air flow. By this, the tertiary air is divided and supplied to the swirling flow generator (A) 113 and the swirling flow generator (B) 114, respectively. The tertiary air 139 is supplied to the swirling flow generator (A) 113, and the tertiary air 140 is supplied to the swirling flow generator (B).

Furthermore, a cylindrical-shaped flow rate control valve 124 is mounted on an upstream inflow port of the swirling flow generator (B) 114. The flow rate control valve 124 receives instructions from the tertiary air flow controller 135 through a connecting bar 131 and moves to the axis of the burner. As this movement changes an upstream pressure loss of the upstream of the swirling flow generator (B) 114, the flow rate of the tertiary air 140 flowing into the swirling flow generator (B) is changed by the flow rate control valve 124.

Figure 2:
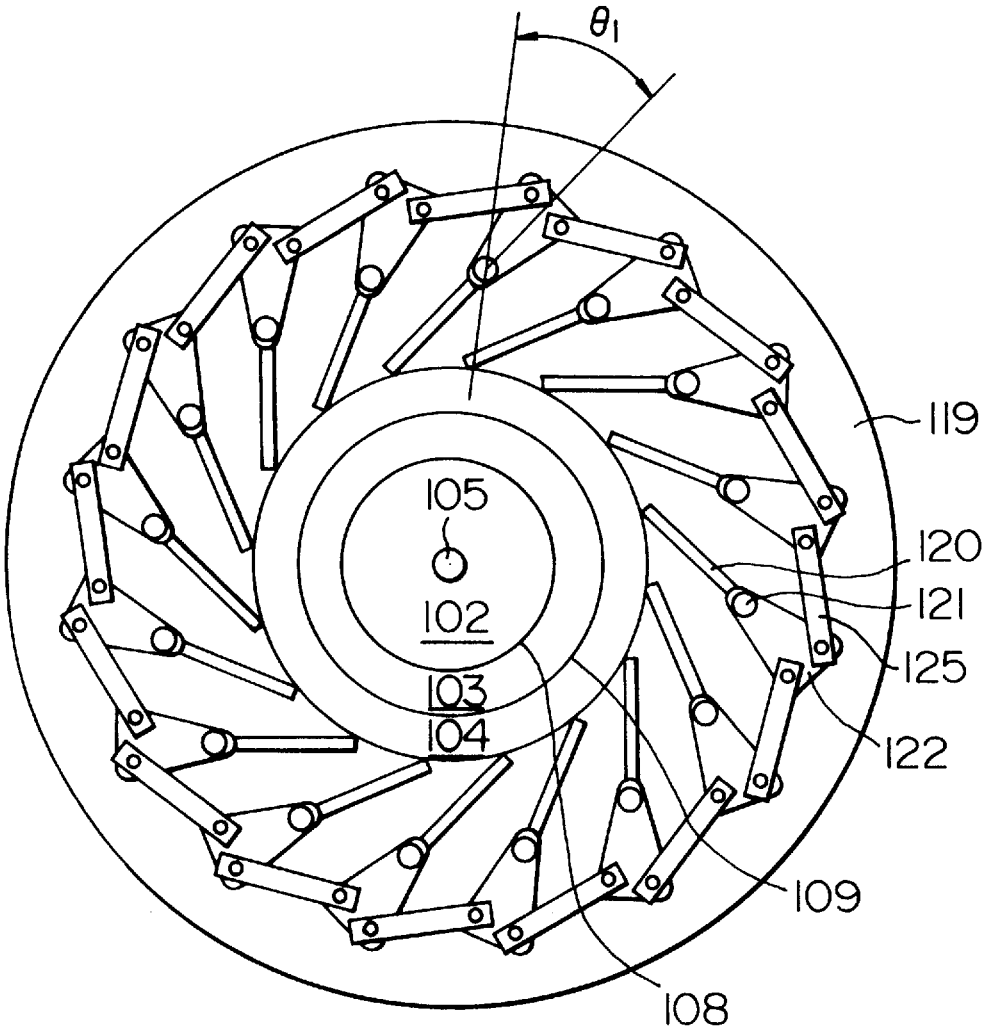
FIG. 2 is a sectional view taken on line II—II of FIG. 1.

An example of the swirling flow generator (B) of this embodiment is shown in FIG. 2. FIG. 2 is a sectional view taken on line II—II of FIG. 1, and shows a structure of the swirling flow generator (B) 114 viewed from the wind box 101 side.

The swirling flow generator (B) 114 is comprised of rectangular register vanes 120 each having a thin plate thickness, cylindrical supporting rods 121 mounted integrally with the register vanes 120, annular supporting plates 123 provided at both ends of the supporting rods 121, a supporting plate 119, connecting rods 125 connecting the register vanes 120, and link mechanisms 122 provided so as to transmit entirely and equally the action of one of the register vanes 120.

One of the supporting rods 121 is connected to a swirling strength controller 133 of the swirling flow generator (B) through the connecting rod 129. The swirling strength controller 133 controls angles of the register vanes, that is, the swirling strength of the swirling flow generator (B) by varying the rotation angle of the connecting rod 129.

The swirling flow generator (A) 113 has the same structure as that of the swirling flow generator (B) 114, and is comprised of register vanes 117, supporting rods 118, link mechanisms 115, supporting plates 116, a swirling strength controller 134 and a connecting rod 130 connecting the link mechanisms and the swirling strength controller 134.

A control device 136 issues instructions regarding the secondary air flow rate controller 132, the swirling strength controller 133 of the swirling flow generator (B), the swirling strength controller 134 of the swirling flow generator (A) and the tertiary air flow rate controller 135 to control the air flow rate and the swirling strength.

The secondary air flow rate controller 132 drives the flow rate control valve 127 through the connecting rod 128 to control the flow rate of the secondary air.

The swirling strength controller 133 drives the link mechanism 122 through the connecting rod 129 to control the open angle $\theta_1$ of the register vane of the swirling flow generator (B) 114.

The swirling strength controller 134 controls the open angle of the register vane of the swirling flow generator (A) 113 through the connecting rod 130.

The tertiary air flow rate controller 135 drives the flow rate control valve 124 to control the flow rate of the tertiary air 140.

A method of supplying swirling flows generated by the swirling flow generators (A) and (B) from the tertiary air nozzle 104 can eliminate the resistance of the flow generated by the walls of the passages as there causes no wall surfaces dividing the passage inside the tertiary air nozzle 104.

Furthermore, by increasing the swirling strength of the swirling flow generator (A) 113 higher than that of the swirling flow generator (B) 114, the venosity of the swirling flow inside of the tertiary air nozzle 104 can be increased as the swirling flow approaches the tertiary throat 110. With these operation, the efficiency for generating the swirling flow of the tertiary air can be rapidly increased.

Figure 3:
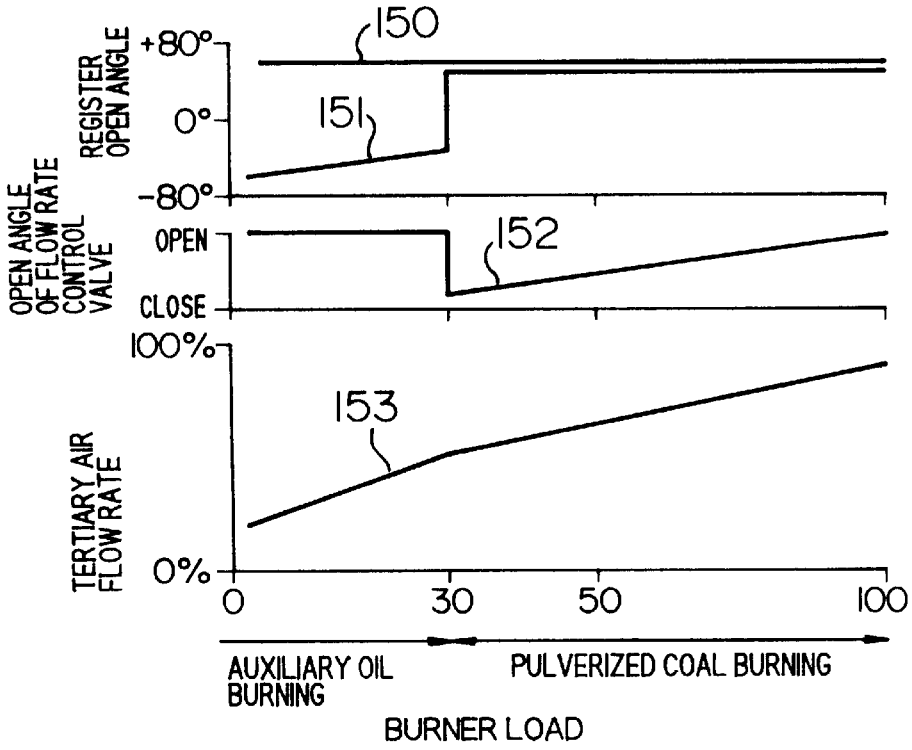
FIG. 3 is a diagram showing driving methods of the tertiary air flow rate, the flow rate control valve and the register open angle when burning with the burner of the embodiment of the present invention.

FIG. 3 shows an example of the driving method using the burner of this embodiment. The burner of this embodiment burns oil alone using the oil as an auxiliary fuel with a burner load of 30% or less, and burns pulverized coals alone in the area of the load higher than the above percentage. A register open angle is an angle $\theta_1$ formed by the register vane 120 and the line linking the central axis of the burner and the central axis of the supporting rod 121. The larger the angle, the greater the swirl number of the swirling flow generator. And, "close" of the flow rate control valve shows a state where the flow rate control valve 124 moves to the furnace to supply more tertiary air to the swirling flow generator (A) 113. The tertiary air flow rate means the flow rate of the air supplied to the swirling flow generator (A) 113 and the swirling flow generator (B) 114.

In the auxiliary oil burning, in the case of less oil supply, the burner of this embodiment set the open angle 150 of the swirling flow generator (A) to +70°, the open angle 151 of the swirling flow generator (B) to −70° and the open angle 152 of the flow rate control valve to a open state. With this operation, the tertiary air flowing into the swirling flow generator (A) 113 and that flowing into the swirling flow generator (B) 114 swirl in the opposite direction to each other. By this, the swirl number of the tertiary air nozzle 104 becomes approximately zero and the tertiary air is supplied as a straight flow. And, since the resister open angles of the swirling flow generators (A) and (B) are large ones, the pressure loss when passing through these swirling flow generators is increased. By this, more combustion air to be supplied to the wind box 101 flows from the secondary air nozzle 103 of a small pressure loss.

As the amount of oil of the auxiliary burning increases, the open angle 151 of the swirling flow generator (B) is reduced near zero while keeping the open angle 152 of the flow rate control valve constant. By this, the swirl number of the tertiary air nozzle 104 increases as the swirling flow generated by the swirling flow generator (B) is weakened, and the tertiary air gradually flows as a swirling flow. And, since the pressure loss of the swirling flow generator (B) 114 decreases, the tertiary air flow rate 153 increases.

When the burner load, which becomes a condition of coal burning, is 30%, the flow rate control valve 152 is closed and then, the open angle 151 of the swirling flow generator (B) becomes equal to the open angle 152 of the swirling flow generator (A). As the burner load increases and the open angle 152 of the flow rate control valve operates to the opening direction, air consistent with the increase of the fuel supply can be supplied.

Figure 4:
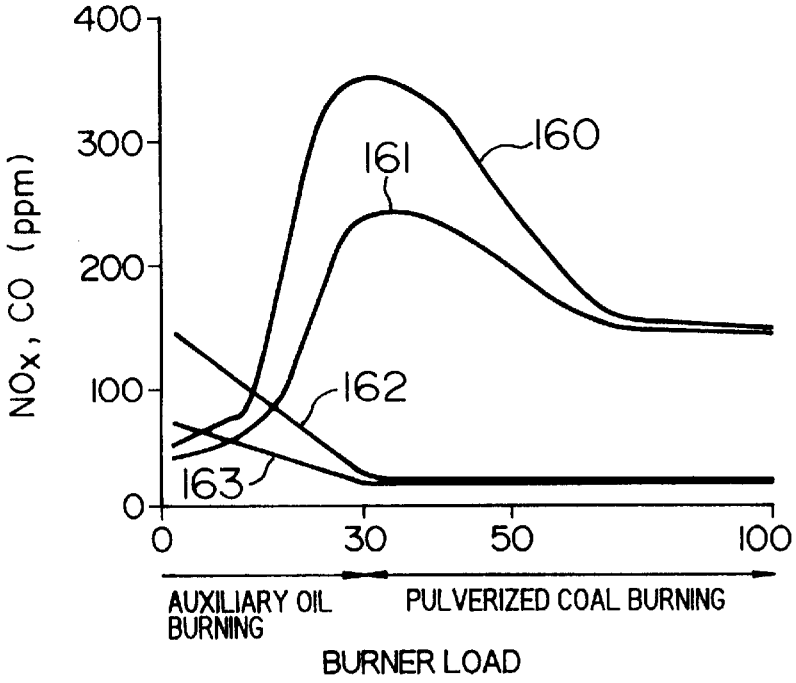
FIG. 4 is a diagram showing characteristics of the NOx concentration and the CO concentration when burned in the embodiment of the present invention.

FIG. 4 shows the NOx concentration and the CO concentration when the burner is operated as shown in FIG. 3. A curve 160 shows the NOx concentration when burned with the conventional burner having only one swirling flow generator, and a curve 161 shows the NOx concentration when burned with the burner of this embodiment. A curve 162 shows the CO concentration when the conventional burner is used, and a curve 163 shows the CO concentration when the burner of this embodiment is used.

In the case of the auxiliary oil burning of this embodiment, more combustion air can be supplied to the secondary air nozzle 103, and further, the tertiary air becomes close to a straight flow. By this, the mixing of the oil spray and the combustion air near the burner can be rendered better than ever to be burned. Thus, the generation of CO due to the air-deficient combustion can be retarded.

And, since the mixing of the tertiary air and the oil spray becomes more sluggish than ever, the NOx concentration is not increased by a sudden mixing of the combustion air.

When the burner load is 30 to 50% in the pulverized coal burning of this embodiment, the flow rate control valve 124 supplies more tertiary air to the swirling flow generator (A) 113. By this, the air flowing into the swirling air generator (A) 113 flows faster than ever. Thus, the velocity of the swirling component of the tertiary air increases. By this, the swirl number of the entire burner increases higher than ever. Thus, a large re-circulating flow of high temperature is formed near the burner, and ignitionability of the pulverized coal is rapidly improved. By the fact that the pulverized coal becomes easy to be fired, the NOx reducing atmosphere near the burner is formed better than ever and the NOx concentration becomes lower than ever.

Embodiment 2

Figure 5:
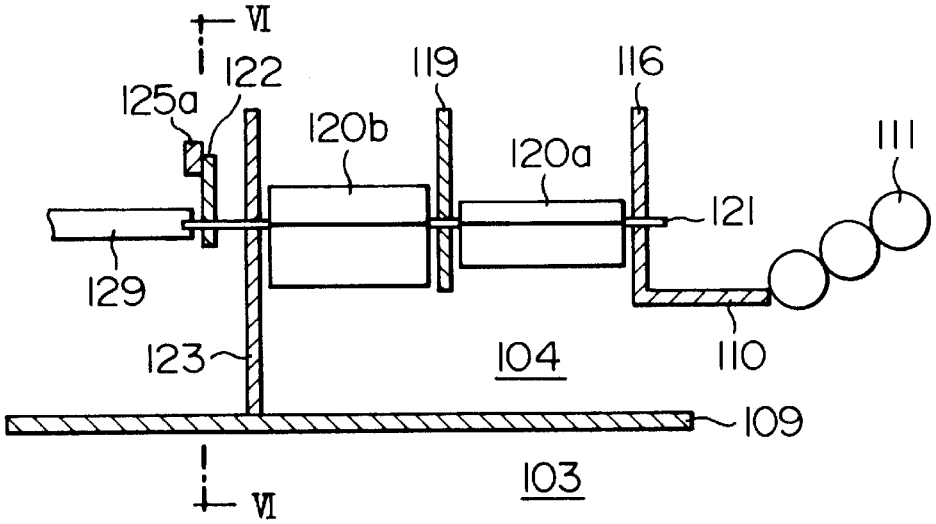
FIG. 5 is a cross-sectional view showing the tertiary air nozzle and the swirling flow generator in the burner of the second embodiment.
Figure 6:
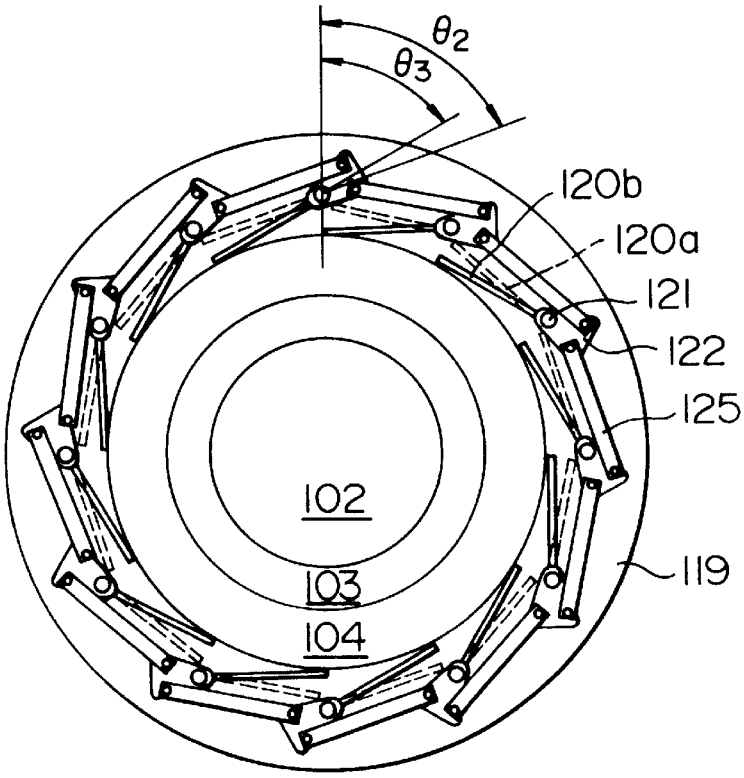
FIG. 6 is a sectional view taken on line VI—VI of the burner in the second embodiment.

The second embodiment will now be described. FIG. 5 is a cross-sectional view of the swirling flow generator of the tertiary air according to this embodiment, and FIG. 6 is a side view of the swirling flow generator. The swirling flow generators (A) and (B) have quite the similar structure to each other. The burner structure of the second embodiment is the same as that of the first embodiment except only the structure of the swirling flow generator of the tertiary air is changed.

The swirling flow generator of the second embodiment is comprised by a cylindrical supporting rod 121, register vanes 120*a* and 120*b* mounted integrally with the supporting rod 121, a link mechanism 122 having the function of making the same rotation angles of a plurality of the supporting rods 121 through the connecting rod 125, the supporting plate 116, the supporting plate 119 and the supporting plate 123. The supporting rod 121 penetrates through the holes formed in the supporting plates 116, 119 and 123. The register vane 120*a* is positioned between the supporting plate 116 and the supporting plate 119, and the register vane 120*b* is positioned between the supporting plate 119 and the supporting plate 123. This arrangement of the supporting plates can prevent the leakage of the tertiary air through a space between two register vanes 120*a* and 120*b*.

The register vanes 120*a* and 120*b* are mounted on the supporting rod 121 with different angles. That is, an angle formed by a virtual line linking the burner axis and the central axis of the supporting rod 121 is set to $\theta_2$ at the register vane 120*a* and is set to $\theta_3$ at the register vane 120*b*, respectively. In the case of the second embodiment, the angle $\theta_2$ is larger than $\theta_3$ by 15°, and thus, the register vane 120*a* can supply air with a stronger swirling flow.

The different angles of the two register vanes produces the following two effects.

The first effect is to increase efficiency of producing the swirling flow at the tertiary air nozzle 104. Since the air is pressed against the outer circumferential direction by means of centrifugal force of the swirling flow, the swirling component of the flow velocity at the tertiary air nozzle 104 is increased as it approaches the tertiary throat 110, which is the outer peripheral wall of the nozzle. On the other hand, the air fed from the register vane 120*a* mainly flows near the tertiary throat 110, and the air fed from the register vane 120*b* flows near the secondary throat 109.

From the positional relation of the register vanes corresponding to the velocity distribution of the tertiary air nozzle 104, as for the setting of the two register vanes, the angle $\theta_2$ of the register vane supplying the air of the outer peripheral side of the tertiary air nozzle 104 may be enlarged, and the angle $\theta_3$ of the register vane supplying the air of the inner peripheral side of the tertiary air nozzle 104 may be reduced. By this, a pressure loss generated by disturbing the swirling flow at the tertiary air nozzle 104 can be eliminated, and the swirling flow supplied from the register vanes can be supplied to the furnace 100 without disturbing the swirling flow.

The second effect is to obtain a good ignition of the pulverized coal so as to form a stable NOx reducing area inside of the flame for reducing the NOx concentration by accelerating the swirling flow of the tertiary air at the time of a low load of the burner. Since the angle $\theta_2$ is larger than the angle $\theta_3$, if the connection rod 129 rotates the supporting rod 121 through the link mechanism 122, the register vane 120*a* is totally closed earlier than the register vane 120*b* and the tertiary air is supplied from one side of the register vane 120*b*. By this, the velocity of the air passing through the register vanes becomes higher than that of the case where the register vanes of the swirling flow generator of the tertiary air are arranged in line, and the velocity of the swirling flow can be increased.

If the velocity of the swirling flow of the tertiary air is increased, the swirl number of the entire burner increases. Therefore, the high temperature re-circulating flow of the combustion gas can be formed near the burner more stably. The re-circulating flow of the combustion gas comes into contact with a jet of the pulverized coal so as to set fire the pulverized coal promptly. Thus, the flame of the pulverized coal is stabilized near the burner. On the other hand, the tertiary air having a large swirl number is not mixed with the pulverized coal jet near the burner.

By the acceleration of the ignition near the burner and the control of air-fuel mixing, the pulverized coal burns in an air-deficient condition. Thus, the NOx reducing area can be formed inside the flame. In the NOx reducing area, gases such as ammonia, cyan and hydrocarbon are evolved in the mid-course phase of the combustion to reduce the NOx.

When the register vane 120*a* is totally closed, the pressure loss at the register vane 120*b* is smaller than that among the register vane 120*a*, the supporting plate 116 and the supporting plate 119. Most of the tertiary air flows from the direction of the register vane 120*b*. Therefore, there is no problem of reducing the swirl number in a condition near the total close of the register vane which is likely to be seen in the conventional swirler having register vanes aligned in a row.

Figure 7:
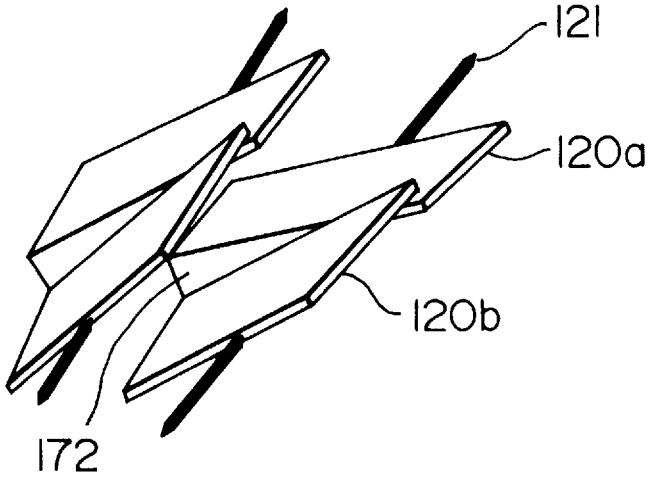
FIG. 7 is a birds-eye view showing the structure of the register vane in another embodiment of the present invention.

FIG. 7 shows a modification of the register vane of the second embodiment. FIG. 7 illustrates two sets of the register vanes, and the structure of the register vane other than these parts are the same as those of the swirling flow generator shown in FIG. 5. The register vane is comprised of the supporting rod 121, the register vanes 120*a* and 120*b* mounted integrally with the supporting rod and a partition plate 172 provided in the form of connecting the end faces of the contact side of the register vanes 120*a* and 120*b* to each other. The register vanes 120*a* and 120*b* are mounted with different angles in the same manner as the second embodiment. The strength of the swirling flow of the register vane 120*a* is set so as to be stronger than that of the register vane 120*b*.

The partition plate 172 eliminates a gap formed in the direction of the burner axis when the register vane 120*a* is totally closed, and erupts the air from the register vane 120*b* alone. By this, the partition plate 172 exhibits a function equal to that of the supporting plate 119 shown in FIG. 5.

Embodiment 3

Figure 8:
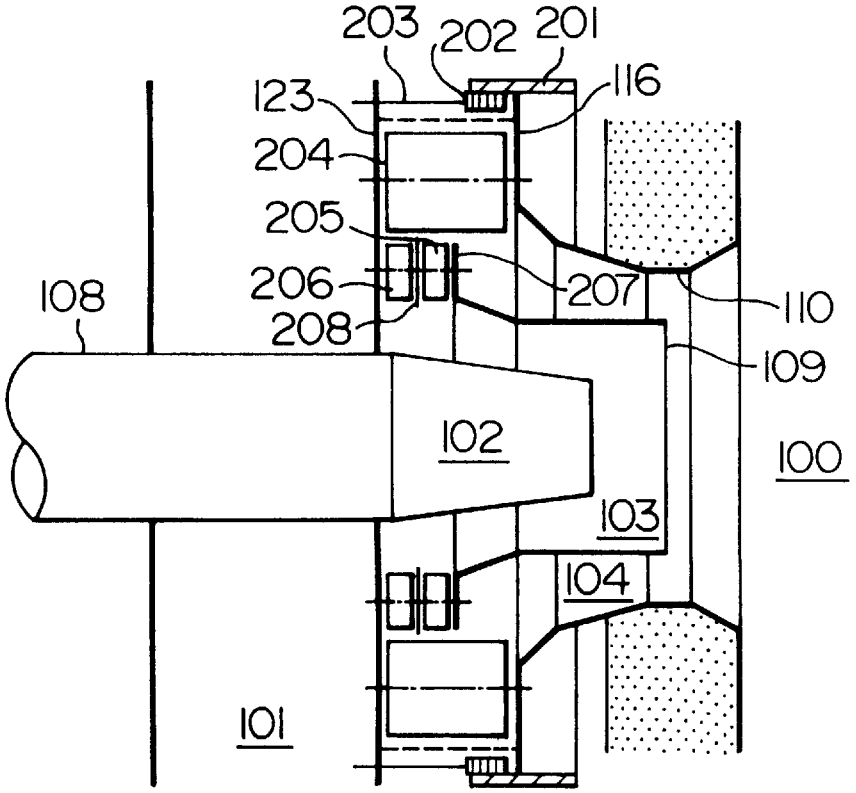
FIG. 8 is a cross-sectional view of the burner in the third embodiment of the present invention.

The third embodiment will now be described. FIG. 8 is a cross-sectional view of a pulverized coal burner including a central axis thereof.

The pulverized coal burner of this embodiment is comprised of the fuel nozzle 102 mounted at the center portion of the burner, the secondary air nozzle 103 concentrically arranged about the fuel nozzle 102, and the tertiary air nozzle 104 mounted on the outer periphery of the secondary air nozzle 103. The fuel nozzle 102 supplies a mixture gas 137 of the primary air and the pulverized coal. The secondary air nozzle 103 and the tertiary air nozzle 104 are passages for supplying a combustion air fed into the wind box 101 to the furnace 100.

The fuel nozzle 102 is a tubular passage having the primary throat 108 as an outer wall, and a passage diameter of the primary throat 108 becomes smaller toward the furnace 100.

The secondary air nozzle 103 is an annular passage having the primary throat 108 as an inner peripheral wall and a secondary throat 109 as an outer peripheral wall. The end face of the secondary throat 109 is positioned at the furnace side nearer than the end face of the primary throat 108. The secondary air nozzle 103 includes two swirling flow generators 205 and 206 provided parallel to the flow of the secondary air toward the upstream from the furnace 100, and further includes a swirling flow generator 204 at upstream of these swirling flow generators. Both swirling flow generators 205 and 206 contain register vanes, and feed the secondary air with a swirling flow. Each of the swirling flow generators 205 and 206 independently has the function capable of controlling the swirling strength thereof. The swirling strength produced by the swirling flow generator 205 is set larger than that produced by the swirling flow generator 206. Furthermore, under the condition of low secondary air flow rate, the swirling generator 205 is in a totally closed condition and the secondary air is supplied from the swirling flow generator alone.

The tertiary air nozzle 104 is an annular passage having the secondary throat 109 as an inner peripheral wall and the tertiary throat 110 as an outer peripheral wall. The tertiary air nozzle 104 includes the swirling flow generator 204 and a movable sleeve 201 at the upstream side and is connected to the wind box 101. Furthermore, the cylindrical-shaped flow rate control valve 124 is mounted on an upstream air inflow port of the swirling flow generator 204. The swirling flow generator 204 is a swirling flow generator containing the register vanes. A part of the air passing through the swirling flow generator 204 is divided in two by a plate 207 mounted on the upstream of the secondary throat 109, and one erupts from the tertiary throat 104 as the tertiary air, and the other erupts from the secondary throat 103 through the swirling flow generators 204 and 205 as the secondary air. The flow rate control valve 124 is comprised of the cylindrical-shaped movable sleeve 201, a controller 202 for moving the movable sleeve 201 to the burner axis, and a supporting rod 203 determining the position of the controller 202.

The movable sleeve 201 operates so as to precisely balance the amount of the air between the burners. The swirling flow generator 204 control the velocity of the tertiary air in the axial direction and the swirling direction. The swirling flow of the tertiary air produces an outer re-circulating flow which is a counter flow supplying the high temperature combustion gas to the burner side near the burner of the furnace 100.

By operating the movable sleeve 201, a part of the air flown into the air inflow port flows to the secondary air nozzle 103 and the velocity in the axial direction and swirling direction thereof is controlled by the swirling flow generators 205 and 206. The swirling flow of the secondary air forms an inner re-circulating flow of a counter flow inside of the secondary throat 109 extending to the furnace. The inner re-circulating flow stably frame-holds the pulverized coal supplied from the fuel nozzle. The swirling strength of the secondary air nozzle 103 is increased, and the more the inner re-circulating flow is stabilized, the higher the stability of flame of the pulverized coal.

Figure 9:
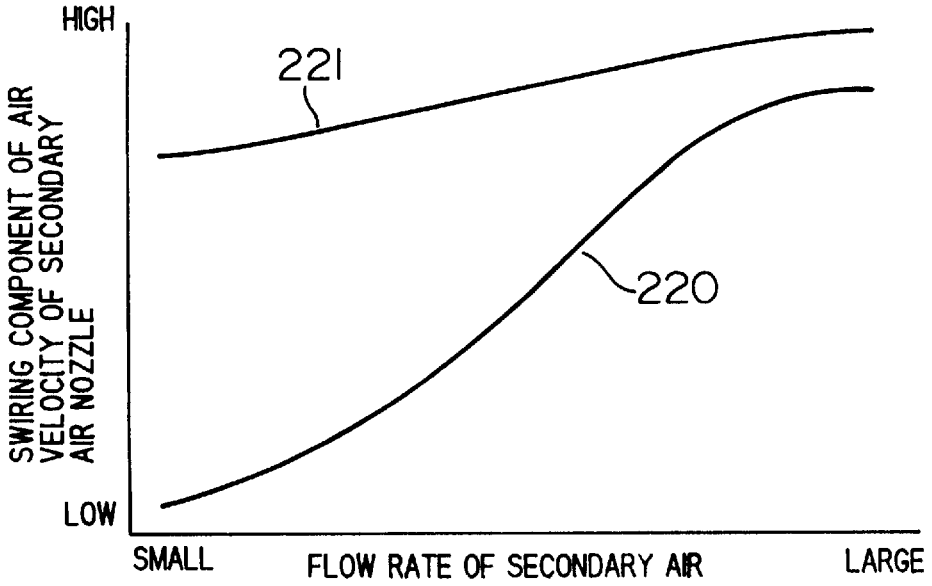
FIG. 9 is a diagram showing the relationship between the secondary air flow rate and the swirling component of the air velocity of the secondary air nozzle when the burner in the third embodiment is used.

FIG. 9 shows a relationship between the flow rate of the secondary air and the swirling components of the air velocity of the secondary air nozzle 103 when a static pressure of the secondary air at an entrance of the register vanes of the swirling flow generator is set constant.

According to a curve 221 showing the embodiment of the present invention, in the case of a large amount of air flow, the swirling strength of the swirling flow generator 205 can be made greater than that of the swirling flow generator 206. Thus, the swirling component of the air velocity of the secondary air nozzle can be increased as compared to the conventional secondary air nozzle provided with only one swirling flow generator under the condition that the same amount of the secondary air is flown. A curve 220 shows the prior art. Furthermore, under the condition of low amount of the secondary air flow, by totally closing one of the swirling flow generators 205 and 206, the secondary air can be distributed by the other swirling flow generator. Therefore, the swirling component of the air velocity of the secondary air nozzle can be increased.

This way, the swirling strength of the secondary air can be made stronger than ever at any flow rate, the above-mentioned inner re-circulating flow is stabilized and the entrainment amount and the residence time of the pulverized coal are increased. Therefore, the ignitionability of the pulverized coal is rapidly increased and stability of the flame of the pulverized coal burner can be increased.

Therefore, since the air is distributed to the tertiary air nozzle to hold the pulverized coal flame, there arises no problem that the secondary air nozzle causes burning.

Embodiment 4

Figure 10:
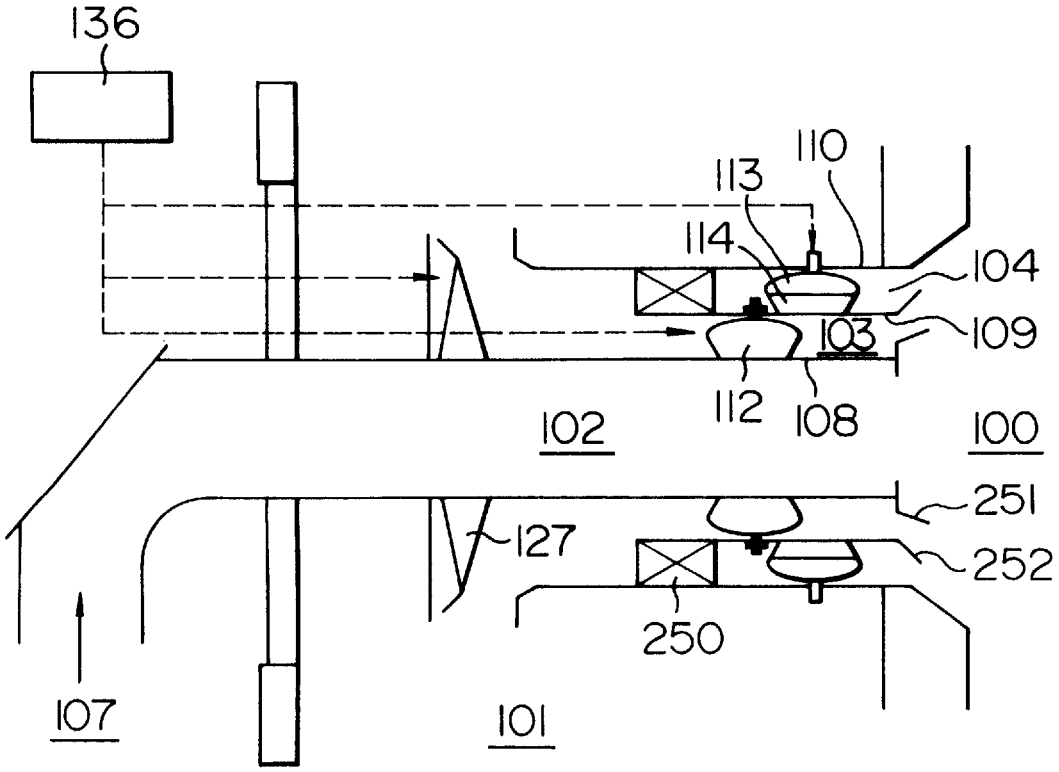
FIG. 10 is a cross-sectional view of the burner in the fourth embodiment of the present invention.

The fourth embodiment will now be described. FIG. 10 is a cross-sectional view of the pulverized coal burner including a central axis thereof. The pulverized coal burner of this embodiment is comprised of the fuel nozzle 102 mounted at the center portion of the burner, the secondary air nozzle 103 concentrically arranged about the fuel nozzle 102, and the tertiary air nozzle 104 mounted on the outer periphery of the secondary air nozzle 103. The fuel nozzle 102 supplies a mixture gas 137 of the primary air and the pulverized coal. The secondary air nozzle 103 and the tertiary air nozzle 104 are passages for supplying a combustion air fed into the wind box 101 to the furnace 100.

The fuel nozzle 102 is a tubular passage having the primary throat 108 as an outer wall, and a flame stabilizer is mounted on the end face of the furnace of the side primary throat 108. A cross section of the flame stabilizer including an axis thereof is L-shaped. One end face of the flame stabilizer 251 reaches from the inner peripheral surface of the primary throat 108 to the inside of the passage. The other end face of the flame stabilizer 251 reaches the inside of the secondary air nozzle 103.

The secondary air nozzle 103 is an annular passage having the primary throat 108 as an inner peripheral surface and a secondary throat 109 as an outer peripheral wall. The downstream side of the secondary air nozzle 103 is connected to the furnace 100. The secondary air nozzle 103 is provided with the swirling flow generator 112. The swirling flow generator 112 is composed of a plurality of semicircular register vanes provided in a circumferential direction, each semicircular vane is defined by connecting an arc and straight lines opposing thereto. There exists a supporting rod for rotating the register vane at the center part of the arc of the register vane. The register vane determines the angle thereof by the instructions of the controller 136 centering the above-mentioned supporting rod. The flow rate control valve 127 changes the flow rate of air flowing through the secondary air nozzle 103 and the tertiary air nozzle 104 by controlling the pressure loss with reducing a cross-sectional area of the inflow port.

The tertiary air nozzle 104 is an annular passage having the secondary throat 109 as an inner peripheral wall and the tertiary throat 110 as an outer peripheral wall. The downstream of the tertiary air nozzle 104 is connected to the furnace 100. Inside the tertiary nozzle 104, a guide sleeve 252, the swirling flow generator (A) 113 and the swirling flow generator (B) 114, and a fixed vane 250 are provided. One upstream end of the guide sleeve 252 is coupled to the end face of the furnace side of the secondary throat 109, and the other end faces to the furnace 100. The guide sleeve 252 reduces the diameter thereof toward the upstream thereof, and has a function of erupting the tertiary air radially to control mixing of the primary air and the tertiary air near the pulverized coal burner.

Figure 11:
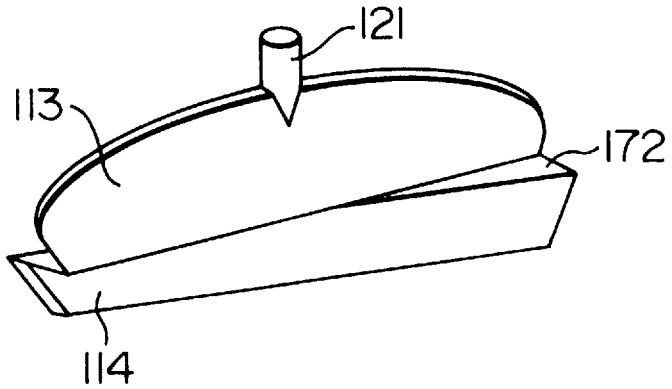
FIG. 11 is a birds-eye view showing the structure of the register vane used in the fourth embodiment.

The structure of the register vane constituting the swirling flow generators (A) and (B) is shown in FIG. 11. The register vane is comprised by the half moon-shaped swirling flow generator (A) 113, the rectangular swirling flow generator (B) 114, the partition plate 172 connecting one ends of the swirling flow generators (A) and (B) to each other, and the supporting rod 121 one of which is coupled to the arc of the swirling flow generator (A) 113. The swirling flow generator (B) 114 is mounted so as to be positioned with an angle formed with the swirling flow generator (A) 113 from the supporting rod 121.

The swirling flow generator 112, the swirling flow generators (A) and (B) and the flow rate control valve 127 are controlled by a controller 136 so that the positions thereof become predetermined setting value.

The angle which the swirling vane of the swirling flow generator (A) 113 forms with the central axis of the burner is set so as to be greater than the angle formed by the swirling flow generator (B) 114. This indicates that the swirling component of the swirling flow of the swirling flow generator (A) 113 can be increased as compared to that of the swirling flow generator (B) 114. The swirling component of the tertiary air nozzle 104 gradually increases as it approaches the tertiary throat 110. Thus, no disturbance attenuating the swirling flow occurs inside of the tertiary air nozzle 104.

Therefore, the swirl number of the tertiary air when the same pressure loss is applied thereto is rapidly increased than ever. By this, since the mixing of the combustion air and the pulverized coal jet near the burner can be further controlled, the NOx reducing area in the flame can be stabilized so as to attain a low NOx combustion.

When the pulverized burner is operated at low load, the tertiary air can be supplied from mainly the swirling flow generator (A) 113 by totally closing the swirling vanes of the swirling flow generator (B) 114. By this, the swirl number of the tertiary air at the time of the low load can be increased and the high temperature combustion gas required for the ignition of the pulverized coal can be drawn close to the burner. Since the high temperature combustion gas sets fire the pulverized coal, flame stability under low load condition is rapidly increased. By this, since pulverized coal burning is attained even in a load zone for which auxiliary burning of oil is conventionally required, oil usage can be reduced.

Furthermore, since the swirling strength of the tertiary air can be increased during a low load condition, mixing of the pulverized coal and the combustion air near the burner can be controlled as compared to the conventional method, and the NOx concentration can be reduced by forming the NOx reducing area inside of the flame.

Advantage of the Invention

According to the present invention, a pulverized coal burner capable of reducing the NOx concentration within all of the drive load range can be provided. And, generation of environmental inhibitors such as soot and the like can be controlled at the time of the auxiliary oil burning.

Furthermore, by applying the pulverized coal burner of the present invention to a pulverized coal power generating facilities, the amount of ammonia used in a NOx removal device provided in the power generation facilities can be reduced.

What is claimed is:

1. A pulverized coal burner comprising at least one air nozzle supplying a combustion air being concentrically positioned about an outer periphery of a fuel nozzle carrying pulverized coal with air flow, wherein at least one of said at least one air nozzle is provided with a plurality of swirling flow generating means capable of controlling swirling strength arranged in parallel with respect to a flow of the combustion air.

2. A pulverized coal burner comprising at least one air nozzle supplying a combustion air being concentrically positioned about an outer periphery of a fuel nozzle carrying a pulverized coal-air mixture flow, wherein at least one of said at least one air nozzle is provided with a plurality of swirling flow generating means capable of controlling an angle of swirl vanes arranged in parallel with respect to a flow of the combustion air.

3. A pulverized coal burner according to claim 1 or 2, further comprising air flow rate control means controlling a flow rate of the combustion air by controlling an open angle of said air nozzle.

4. A pulverized coal burner according to claim 1 or 2, wherein two swirling flow generators are provided inside of said air nozzle parallel to a flow of the combustion air so as to reverse a swirling direction.

5. A pulverized coal burner according to claim 1, wherein an oil gun is provided inside of said fuel nozzle.

6. A pulverized coal burner comprising a secondary air nozzle supplying a combustion secondary air with a swirling flow and a tertiary air nozzle supplying a combustion tertiary air with a swirling flow being concentrically positioned about an outer periphery of a fuel nozzle carrying a pulverized coal-combustion primary air mixture flow, wherein two swirling flow generating means capable of controlling swirling strength arranged in parallel with respect to a flow of the combustion tertiary air are provided inside of said tertiary air nozzle, and wherein said burner is provided with secondary air flow rate control means controlling an open angle of said secondary air nozzle, tertiary air flow rate control means controlling an open angle of said tertiary air nozzle, and control means controlling open angles of said secondary air flow rate control means and said tertiary air flow rate control means in accordance with load instructions, and swirling strength of said two swirling flow generating means provided inside of said tertiary air nozzle.

* * * * *